US011118794B1

(12) United States Patent
Longenecker et al.

(10) Patent No.: US 11,118,794 B1
(45) Date of Patent: Sep. 14, 2021

(54) AIR CONDITIONER UNITS AND METHODS FOR HEATER ASSEMBLY PROTECTION

(71) Applicant: Haier US Appliance Solutions, Inc., Wilmington, DE (US)

(72) Inventors: Joshua Duane Longenecker, Louisville, KY (US); Robert T. Mills, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/929,615

(22) Filed: Jul. 15, 2020

(51) Int. Cl.
*F24F 11/74* (2018.01)
*F24F 11/88* (2018.01)
*F24F 1/0093* (2019.01)

(52) U.S. Cl.
CPC ..... *F24F 1/0093* (2019.02); *F24F 11/74* (2018.01); *F24F 11/88* (2018.01)

(58) Field of Classification Search
CPC ..... F24F 1/0093; F24F 1/009; F24F 11/41; F24F 11/43
See application file for complete search history.

(56) References Cited

U.S. PATENT DOCUMENTS 10,274,945 B2 4/2019 Abiprojo
10,889,163 B2 * 1/2021 Tada ..... B60H 1/00899
2014/0130527 A1 * 5/2014 Dumas ..... F25J 1/0294 62/115
2016/0061465 A1 * 3/2016 Billman ..... F24F 1/00 165/121
2016/0061466 A1 * 3/2016 Billman ..... F24F 11/77 165/121
2016/0061467 A1 * 3/2016 Billman ..... F24F 1/02 62/56
2018/0299155 A1 * 10/2018 Walsh ..... F24F 11/46
2020/0132320 A1 * 4/2020 Shaffer ..... F24F 11/32
2020/0132334 A1 * 4/2020 Shaffer ..... F24F 1/027
(Continued)

FOREIGN PATENT DOCUMENTS

CN 109506335 A * 3/2019
CN 110131793 A * 8/2019
CN 110701743 A * 1/2020
(Continued)

*Primary Examiner* — Nelson J Nieves
(74) *Attorney, Agent, or Firm* — Dority & Manning, P.A.

(57) ABSTRACT

An air conditioner unit, as provided herein, may include a cabinet, an outdoor heat exchanger, an indoor heat exchanger, a compressor, a heater bank array, and a controller. The compressor may be in fluid communication with the outdoor heat exchanger and the indoor heat exchanger to circulate a refrigerant between the outdoor heat exchanger and the indoor heat exchanger. The heater bank array may include a plurality of heater banks mounted within the indoor portion. The controller may be in operative communication with the compressor and the heater bank array. The controller may be configured to initiate a heating operation. The heating operation may include detecting objectionable heating unit performance of the heater bank array, reducing an electric power load of the heater bank array in response to detecting objectionable heating unit performance, and directing a modified heat cycle based on detecting objectionable heating unit performance.

16 Claims, 7 Drawing Sheets

(56) References Cited

U.S. PATENT DOCUMENTS

| | | | | |
|---|---|---|---|---|
| 2020/0347585 | A1* | 11/2020 | Kim | F25B 21/02 |
| 2020/0363105 | A1* | 11/2020 | Kumakura | C09K 5/045 |

FOREIGN PATENT DOCUMENTS

| | | | | | |
|---|---|---|---|---|---|
| CN | 110986198 | A | * | 4/2020 | |
| CN | 110986274 | A | * | 4/2020 | |
| CN | 111089421 | A | * | 5/2020 | |
| CN | 111336659 | A | * | 6/2020 | |
| JP | 59012236 | A | * | 1/1984 | F24F 11/30 |
| JP | H07180881 | A | | 7/1995 | |
| JP | H08327196 | A | | 12/1996 | |
| KR | 101343438 | B1 | * | 12/2013 | |

* cited by examiner

AIR CONDITIONER UNITS AND METHODS FOR HEATER ASSEMBLY PROTECTION

FIELD OF THE INVENTION

The present subject matter relates generally to air conditioning appliances, and more particularly to air conditioner units and methods for protecting a heater assembly thereof.

BACKGROUND OF THE INVENTION

Air conditioner units are typically used to adjust the temperature within structures, such as dwellings or office buildings. In particular, one-unit type or single-package room air conditioner units, such as window units, single-package vertical units (SPVU), vertical packaged air conditioners (VPAC), or package terminal air conditioners (PTAC) may be used to adjust the temperature in, for example, a single room or group of rooms of a structure. Such an air conditioner unit typically includes an indoor portion and an outdoor portion. The indoor portion is generally located indoors, and the outdoor portion is generally located outdoors. Accordingly, the air conditioner typically extends through a wall, window, etc. of the structure.

The outdoor portion of a conventional air conditioner unit typically includes a compressor, an outdoor heat exchanger connected to the compressor and an outdoor fan for cooling the outdoor heat exchanger. Similarly, the indoor portion of a conventional air conditioner unit typically includes an air inlet and an air outlet positioned along the front portion of the unit facing the interior of the room. In addition, the indoor portion typically includes a blower fan, a heating system and an indoor heat exchanger connected to the compressor.

During a cooling operation, the compressor is driven to implement a refrigeration cycle, with the indoor heat exchanger serving as a cold-side evaporator of the refrigeration cycle and the outdoor heat exchanger serving as a hot-side condenser. The outdoor heat exchanger is cooled by the outdoor fan to dissipate heat. As the blower fan is driven, the air inside the room flows through the air inlet, has its temperature lowered via heat transfer with the indoor heat exchanger and is then blown into the room through the air outlet in order to cool the room.

During a heating operation, the heating system is operated to raise the temperature of air flowing through the unit. For example, the heating system typically includes a plurality of heating coils configured to heat the air passing through the unit. Thus, air directed through the unit is heated by the heating coils and is subsequently discharged therefrom via the air outlet in order to heat the room.

To prevent an air conditioner unit from overheating during its heating operation, a thermostat is typically provided in operative association with the heating system that is configured to regulate the internal temperature of the unit by cutting the power to the heating coils off when the internal temperature exceeds a predetermined cut-off temperature. Unfortunately, if air or heat is inadvertently held within the air conditioner (e.g., at the outlet, such as by an article of clothing), the thermostat may be cycled or cutoff excessively. Such excessive cycling may be inefficient or ineffective to heat a room. Additionally or alternatively, excessive cycling may cause certain portions of the air conditioner unit to rapidly wear out, thereby shortening their useful lifespan or reliability.

Accordingly, an air conditioner unit or heater assembly addressing one or more of the above issues would be useful. In particular, it may be advantageous to provide an air conditioner unit (or method of using the same) having one or more features for improving heating efficiency or efficacy (e.g., when airflow or heat is obstructed or otherwise restricted). Additionally or alternatively, it may be advantageous to provide an air conditioner unit (or method of using the same) having one or more features for improving the life or reliability of the unit.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating an air conditioner unit is provided. The method may include detecting objectionable heating unit performance of a heater bank array of the air conditioner unit. The method may further include reducing an electric power load of the heater bank array in response to detecting objectionable heating unit performance. The method may still further directing a modified heat cycle based on detecting objectionable heating unit performance.

In another exemplary aspect of the present disclosure, an air conditioner unit is provided. The air conditioner unit may include a cabinet, an outdoor heat exchanger, an indoor heat exchanger, a compressor, a heater bank array, and a controller. The cabinet may define an outdoor portion and an indoor portion. The outdoor heat exchanger may be disposed in the outdoor portion. The indoor heat exchanger may be disposed in the indoor portion. The compressor may be in fluid communication with the outdoor heat exchanger and the indoor heat exchanger to circulate a refrigerant between the outdoor heat exchanger and the indoor heat exchanger. The heater bank array may include a plurality of heater banks mounted within the indoor portion. The controller may be in operative communication with the compressor and the heater bank array. The controller may be configured to initiate a heating operation. The heating operation may include detecting objectionable heating unit performance of the heater bank array, reducing an electric power load of the heater bank array in response to detecting objectionable heating unit performance, and directing a modified heat cycle based on detecting objectionable heating unit performance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
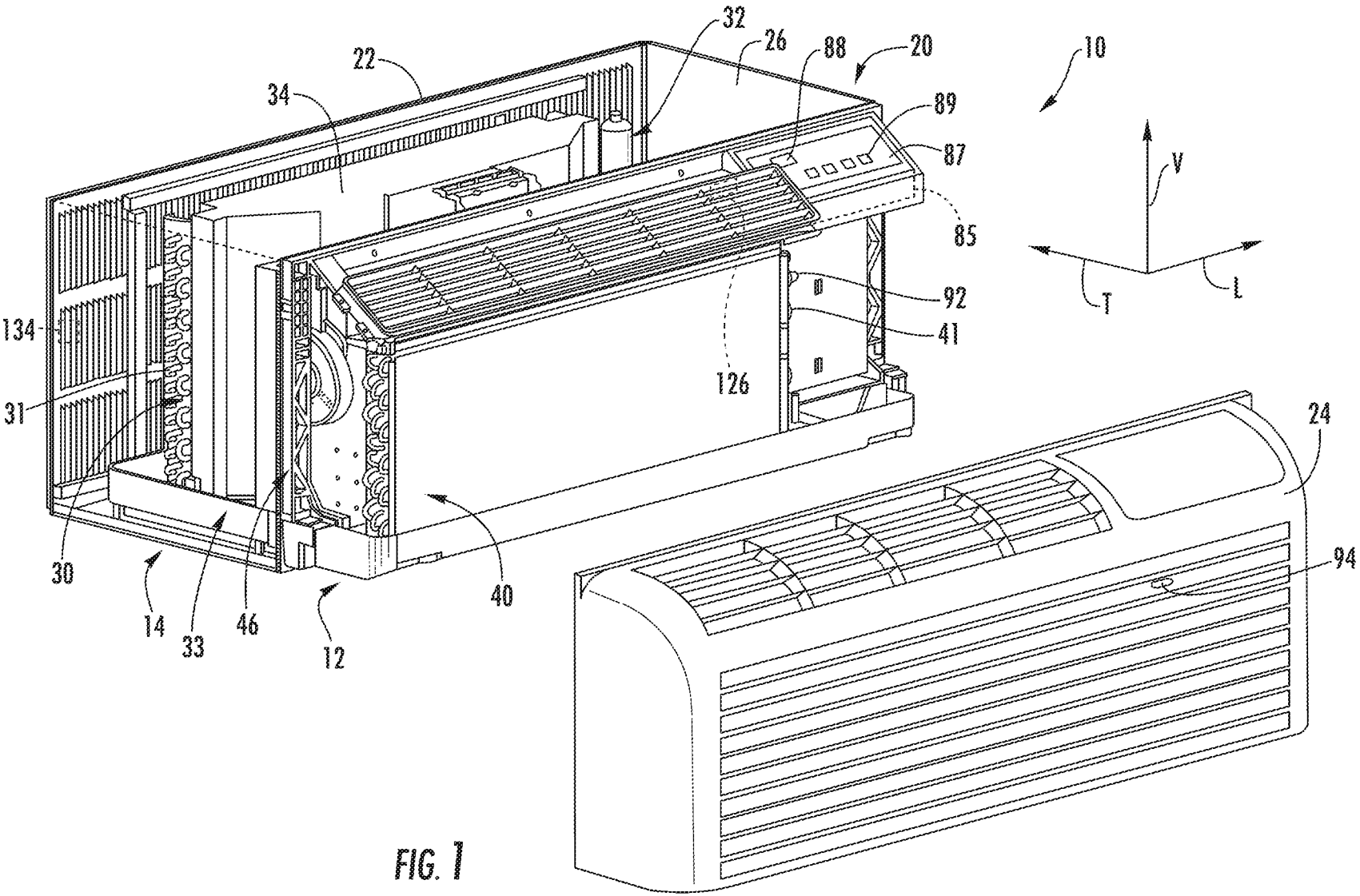
FIG. 1 provides a perspective view of an air conditioner unit, with a room front exploded from a remainder of the air conditioner unit for illustrative purposes, in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The phrase "in one embodiment," does not necessarily refer to the same embodiment, although it may. The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Referring now to the figures, in FIGS. 1 through 5, an air conditioner 10 according to various exemplary embodiments is provided. The air conditioner 10 is generally a one-unit type air conditioner, also conventionally referred to as a room air conditioner or package terminal air conditioner unit (PTAC). The air conditioner 10 includes an indoor portion 12 and an outdoor portion 14, and defines a vertical direction V, a lateral direction L, and a transverse direction T. Each direction V, L, T is perpendicular to each other, such that an orthogonal coordinate system is generally defined.

Although described in the context of a PTAC, an air conditioner unit as disclosed herein may be provided as a window unit, single-package vertical unit (SPVU), vertical packaged air conditioner (VPAC), or any other suitable single-package air conditioner. The air conditioner 10 is intended only as an exemplary unit and does not otherwise limit the scope of the present disclosure. Thus, it is understood that the present disclosure may be equally applicable to other types of air conditioner units.

Generally, a cabinet 20 of the air conditioner 10 contains various other components of the air conditioner 10. Cabinet 20 may include, for example, a rear grill 22 and a room front 24 that may be spaced apart along the transverse direction T by a wall sleeve 26. The rear grill 22 may be part of the outdoor portion 14, while the room front 24 is part of the indoor portion 12. Components of the outdoor portion 14, such as an outdoor heat exchanger 30, outdoor fan 33 (FIG. 5), and compressor 32 may be housed within the wall sleeve 26. A casing 34 may additionally enclose the outdoor fan 33, as shown.

Figure 2:
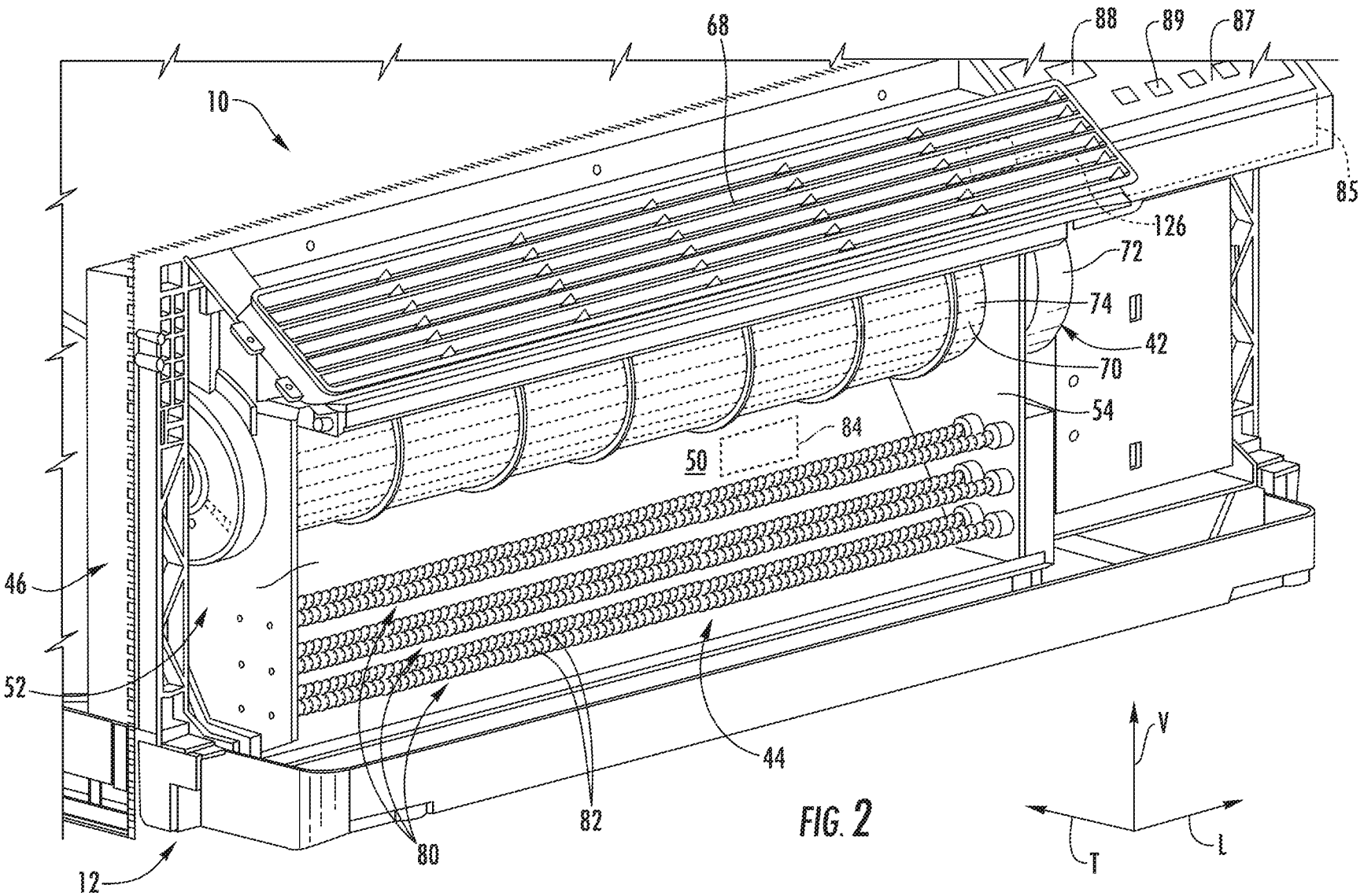
FIG. 2 is a perspective view of components of an indoor portion of an air conditioner unit in accordance with exemplary embodiments of the present disclosure.
Figure 3:
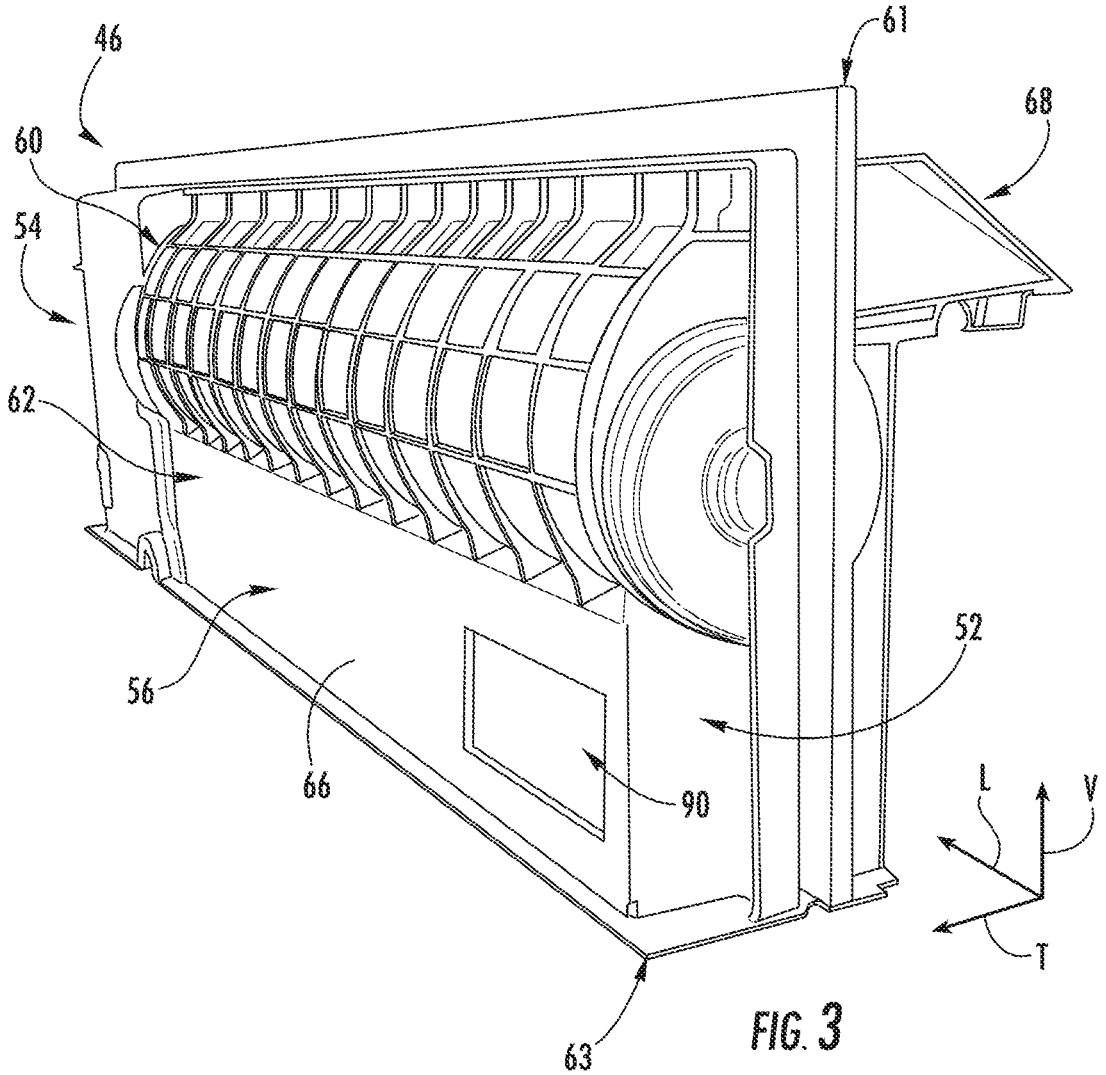
FIG. 3 is a rear perspective view of a bulkhead assembly in accordance with exemplary embodiments of the present disclosure.

Referring now also to FIG. 2, indoor portion 12 may include, for example, an indoor heat exchanger 40, a blower fan 42, and a heating unit 44. These components may, for example, be housed behind the room front 24. Additionally, a bulkhead 46 may generally support or house various other components or portions thereof of the indoor portion 12, such as the blower fan 42 and the heating unit 44. Bulkhead 46 may generally separate and define the indoor portion 12 and outdoor portion 14.

Outdoor and indoor heat exchangers 30, 40 may be components of a thermodynamic assembly (i.e., sealed system), which may be operated as a refrigeration assembly (and thus perform a refrigeration cycle) and, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode). As described herein "activating a heat pump" is understood to indicate activating a compressor (e.g., compressor 32—FIG. 5) to perform a heat pump cycle.

Figure 5:
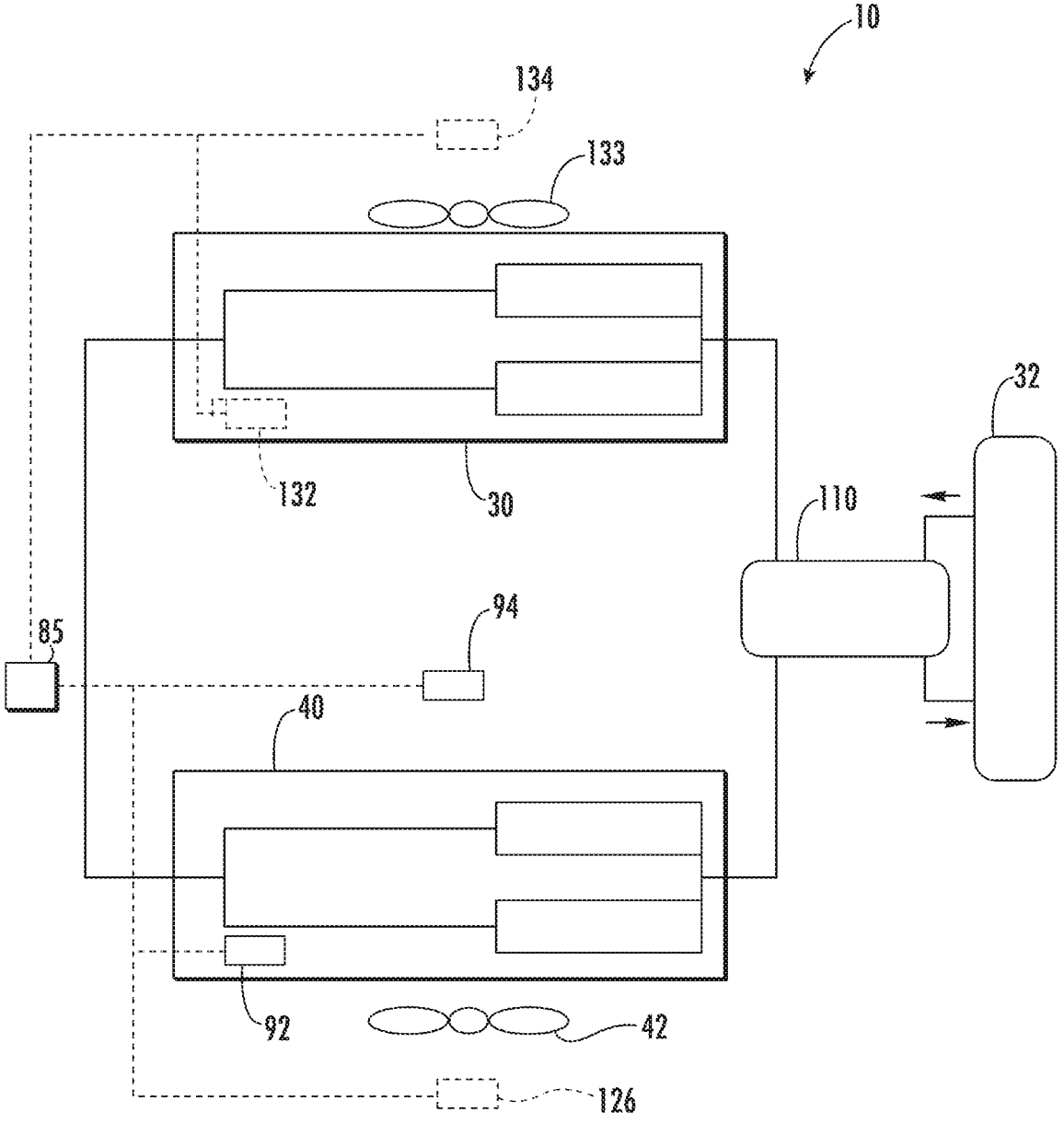
FIG. 5 provides a schematic view of an air conditioner unit according to exemplary embodiments of the present disclosure.

In optional embodiments, such as exemplary heat pump unit embodiments, the sealed system includes a reversible refrigerant valve 110 (FIG. 5). Reversible refrigerant valve 110 selectively directs compressed refrigerant from compressor 32 to either indoor heat exchanger 40 or outdoor heat exchanger 30. For example, in a cooling mode for a refrigeration cycle, reversible refrigerant valve 110 is arranged or configured to direct compressed refrigerant from compressor 32 to outdoor heat exchanger 30. Conversely, in a heating mode for a heat pump cycle, reversible refrigerant valve 110 is arranged or configured to direct compressed refrigerant from compressor 32 to indoor heat exchanger 40. Thus, reversible refrigerant valve 110 permits the sealed system to adjust between the refrigeration cycle and the heat pump cycle, as will be understood by those skilled in the art.

The thermodynamic assembly may, for example, further include compressor 32 and an expansion valve, both of which may be in fluid communication with the heat exchangers 30, 40 to flow refrigerant therethrough, as is generally understood. Optionally, the compressor 32 may be a variable speed compressor or, alternatively, a single speed compressor. When the thermodynamic assembly is operating in a cooling mode, and thus performs a refrigeration cycle, the indoor heat exchanger 40 acts as an evaporator and the outdoor heat exchanger 30 acts as a condenser. In heat pump unit embodiments, when the thermodynamic assembly is operating in a heating mode, and thus performs a heat pump cycle, the indoor heat exchanger 40 acts as a condenser and the outdoor heat exchanger 30 acts as an evaporator. The outdoor and indoor heat exchangers 30, 40 may each include coils 31, 41, as illustrated, through which a refrigerant may flow for heat exchange purposes, as is generally understood.

Bulkhead 46 may include various peripheral surfaces that define an interior 50 thereof. For example, and additionally referring to FIG. 3, bulkhead 46 may include a first sidewall 52 and a second sidewall 54 which are spaced apart from each other along the lateral direction L. A rear wall 56 may extend laterally between the first sidewall 52 and second sidewall 54.

The rear wall 56 may, for example, include an upper portion 60 and a lower portion 62. Upper portion 60 may for example have a generally curvilinear cross-sectional shape, and may accommodate a portion of the blower fan 42 when blower fan 42 is housed within the interior 50. Lower portion 62 may have a generally linear cross-sectional shape, and may be positioned below upper portion 60 along the vertical direction V. Rear wall 56 may further include an indoor facing surface 64 and an opposing outdoor facing surface. The indoor facing surface 64 may face the interior 50 and indoor portion 12, and the outdoor facing surface 66 may face the outdoor portion 14.

Bulkhead 46 may further extend between a top end 61 and a bottom end 63 along vertical axis V. Upper portion 60 may, for example, include top end 61, while lower portion 62 may, for example, include bottom end 63.

Bulkhead 46 may additionally include, for example, an air diverter 68, which may extend between the sidewalls 52, 54 along the lateral direction L and through which air may flow.

In exemplary embodiments, blower fan 42 may be a tangential fan. Alternatively, however, any suitable fan type may be used. Blower fan 42 may include a blade assembly 70 and a motor 72. The blade assembly 70, which may include one or more blades disposed within a fan housing 74, may be disposed at least partially within the interior 50 of the bulkhead 46, such as within the upper portion 60. As shown, blade assembly 70 may for example extend along the lateral direction L between the first sidewall 52 and the second sidewall 54. The motor 72 may be connected to the blade assembly 70, such as through the fan housing 74 to the blades via a shaft. Operation of the motor 72 (e.g., at one or more speed settings) may rotate the blades, thus generally operating the blower fan 42. Further, in exemplary embodiments, motor 72 may be disposed exterior to the bulkhead 46. Accordingly, the shaft may for example extend through one of the sidewalls 52, 54 to connect the motor 72 and blade assembly 70.

In exemplary embodiments, a heating assembly or heating unit 44 includes or is provided as a heater bank array having one or more heater banks 80 (e.g., in fluid communication with blower fan 42 to heat the airflow through indoor portion 12). Each heater bank 80 may be individually powered from a current source, separately from other heater banks 80, so as to provide heat. As shown in the illustrated embodiment, the heating unit 44 includes three heater banks 80 within the interior 50. However, in other embodiments, the heating unit 44 may include any other suitable number of heater banks 80. Additionally, in some embodiments, each heater bank 80 may have a different rated power level. Thus, each heater bank 80 may operate at a different power load. Optionally, in one embodiment, the heating unit 44 may include a low power heater bank, which operates or can be cycled at a comparatively low power load; a medium power heater bank, which operates or can be cycled at a comparatively intermediate power load; and a high power heater bank, which operates at a comparatively high power load. For example, the low power, medium power, and high power heater banks 80 may optionally include a 1000 Watt heater bank, a 3500 Watt heater bank, and a 5000 Watt heater bank, respectively.

Each heater bank 80 may include at least one coil pass or heating coil 82 (e.g., resistive heating element). For example, as shown in FIG. 2, each heater bank 80 includes two heating coils 82. However, in other embodiments, each heater bank 80 may include a single heating coil 82 or three or more heating coils 82. Additionally, in several embodiments, the heater banks 80 may be configured to be stacked vertically, with the coils 82 of each heater bank 80 being arranged side-by-side. For example, as shown in the illustrated embodiment, the heater banks 80 may be stacked vertically such that the heating unit 44 includes a two-by-three array of heating coils 82.

The operation of air conditioner 10 including compressor 32 (and thus the sealed system generally), blower fan 42, fan 33, heating unit 44, and other suitable components may be controlled by a control board or controller 85. Controller 85 may be in communication (via for example a suitable wired or wireless connection) to such components of the air conditioner 10. By way of example, the controller 85 may include a memory and one or more processing devices such as microprocessors, CPUs or the like, such as general or special purpose microprocessors operable to execute programming instructions or micro-control code associated with operation of air conditioner 10. The memory may be a separate component from the processor or may be included onboard within the processor. The memory may represent random access memory such as DRAM, or read only memory such as ROM or FLASH. Generally, the processor executes programming instructions stored in memory.

Air conditioner 10 may additionally include a control panel 87 and one or more user inputs 89, which may be included in control panel 87. The user inputs 89 may be in communication with the controller 85. A user of the air conditioner 10 may interact with the user inputs 89 to operate the air conditioner 10 (e.g., select a temperature setpoint corresponding to a desired room temperature), and user commands may be transmitted between the user inputs 89 and controller 85 to facilitate operation of the air conditioner 10 based on such user commands. A display 88 may additionally be provided in the control panel 87, and may be in communication with the controller 85. Display 88 may, for example be a touchscreen or other text-readable display screen, or alternatively may simply be a light that can be activated and deactivated as required to provide an indication of, for example, a setpoint or setting (e.g., heating or cooling) for the air conditioner 10.

Figure 4:
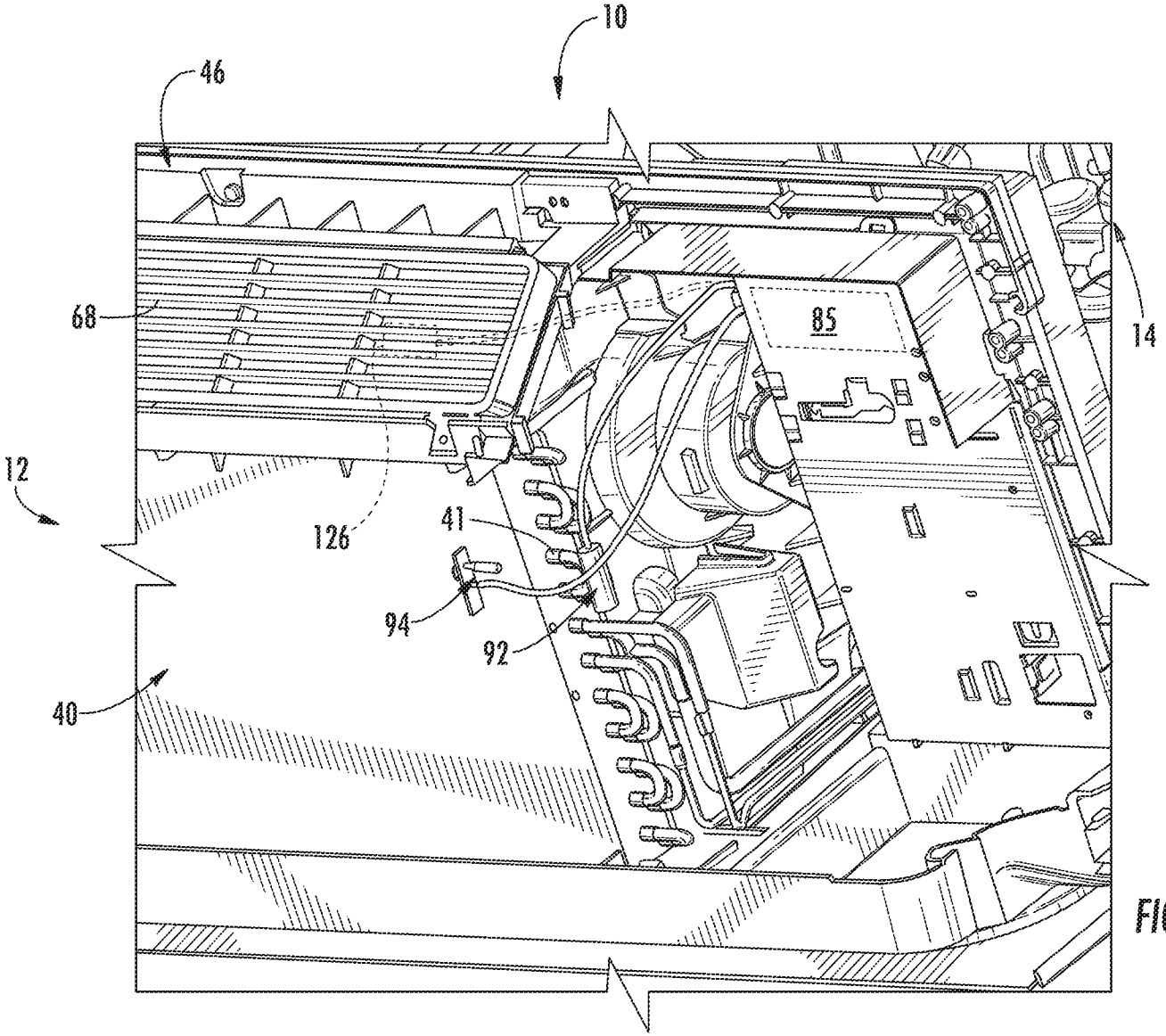
FIG. 4 is another perspective view of components of an indoor portion of an air conditioner unit in accordance with exemplary embodiments of the present disclosure.

Referring now to FIGS. 1, 4, and 5, a first indoor temperature sensor 92 (e.g., indoor refrigerant temperature sensor) or a second indoor temperature sensor 94 (e.g., indoor ambient temperature sensor) may be disposed within the indoor portion 12. In optional embodiments, a third indoor temperature sensor 126 (e.g., indoor outlet temperature sensor) (as indicated in phantom lines) is disposed within the indoor portion 12. In alternative embodiments, indoor portion 12 is free of any such third indoor temperature sensor 126. Each temperature sensor may be configured to sense the temperature of its surroundings. For example, each temperature sensor may be a thermistor or a thermocouple. The indoor temperature sensors 92, 94, 126 may be in communication with the controller 85, and may transmit temperatures sensed thereby to the controller 85 (e.g., as one or more voltages or signals, which the controller 85 is configured to interpret as temperature values). Optionally, the voltages or signal transmitted to the controller 85 may be transmitted in response to a polling request or signal received by one or more of the indoor temperature sensors 92, 94, 126. For example, a polling request or signal may be transmitted to one or more of the indoor temperature sensors 92, 94, 126 from the controller 85.

First indoor temperature sensor 92 may be disposed proximate the indoor heat exchanger 40 (such as relative to the second indoor temperature sensor 94). For example, in some embodiments, first indoor temperature sensor 92 may be in contact with the indoor heat exchanger 40, such as with a coil 41 thereof. The first indoor temperature sensor 92 may be configured to detect a temperature for the indoor heat exchanger 40. Second indoor temperature sensor 94 may be spaced from the indoor heat exchanger 40, such as in the transverse direction T. For example, the second indoor temperature sensor 94 may be in contact with the room front 24, as illustrated in FIG. 1. Second indoor temperature sensor 94 may be configured to detect a temperature of air entering the indoor portion 12. Third indoor temperature sensor 126 may be spaced apart from and disposed downstream of both the first indoor temperature sensor 92 and the second indoor temperature sensor 94. For example, the third indoor temperature sensor 126 may be attached to or in contact with the air diverter 68. The third indoor temperature sensor 126 may be configured to detect a temperature for air exiting the indoor portion 12. During certain operations (e.g., cooling operations), air may thus generally flow across or adjacent to the second indoor temperature sensor 94, the first indoor temperature sensor 92, and then the third indoor temperature sensor 126.

Referring especially to FIGS. 1 and 5, some embodiments, such as exemplary heat pump unit embodiments, a first outdoor temperature sensor 132 (e.g., outdoor refrigerant temperature sensor) (as indicated in phantom lines) and a second outdoor temperature sensor 134 (e.g., outdoor ambient temperature sensor) (as indicated in phantom lines) are disposed within the outdoor portion 14. Each temperature sensor may be configured to sense the temperature of its surroundings. For example, each temperature sensor may be a thermistor or a thermocouple. The outdoor temperature sensors 132, 134 may be in communication with the controller 85, and may transmit temperatures sensed thereby to the controller 85 (e.g., as one or more voltage signals, which the controller 85 is configured to interpret as temperature readings).

First outdoor temperature sensor 132 may be disposed proximate the outdoor heat exchanger 30 (such as relative to the second outdoor temperature sensor 134). For example, in some embodiments, first outdoor temperature sensor 132 may be in contact with the outdoor heat exchanger 30, such as with a coil 31 thereof. The first outdoor temperature sensor 132 may be configured to detect a temperature for the outdoor heat exchanger 30. Second outdoor temperature sensor 134 may be spaced from the outdoor heat exchanger 30, such as in the transverse direction T. For example, the second outdoor temperature sensor 134 may be in contact with the rear grill 22. The second outdoor temperature sensor 134 may be configured to detect a temperature for air entering the outdoor portion 14. During certain operations (e.g., heating operations), air may thus generally flow across or adjacent to the second outdoor temperature sensor 134 and then the first outdoor temperature sensor 132.

As shown in FIG. 2, separate from or in addition to temperature sensors 92, 94, 126, 132, 134, in some embodiments, the heating unit 44 includes a thermostat assembly 84 having multiple discrete thermostats (e.g., for directing or influencing operation of the heater banks 80). For example, the thermostat assembly 84 may include one or more resettable thermostats or one-shot thermostats (e.g., mounted within the interior 50). In some embodiments, the thermostat assembly 84 is positioned above the heater banks 80 or heating coils 82 (e.g., above the top row of heating coils 82). For instance, the thermostat assembly 84 may be positioned above the heating coils 82 along the vertical direction V. The thermostat assembly 84 may be aligned with the heater banks 80 or heating coils 82 (e.g., such that thermostat assembly 84 shares a common location with the heater banks 80 or heating coils 82 along the transverse direction T) or, alternatively, offset from the heating coils 82 (e.g., such that the thermostat assembly 84 is rearward from the heater banks 80 or heating coils 82 along the transverse direction T).

In general, the thermostat assembly 84 may be configured to regulate the internal temperature within the air conditioner unit 10 (e.g., as directed by the heating unit 44). Specifically, in certain embodiments, when the air temperature directly above the heater banks 80 or heating coils 82 exceeds a predetermined threshold temperature (i.e., cut-off temperature), one or more thermostats of the thermostat assembly 84 may be configured to cut the supply of power to the heating coils 82. For example, each thermostat may include a temperature sensitive element, such as bimetallic spring element or a thermal fuse, that is configured to adjust its position (e.g., by springing or bowing inwardly or outwardly or by snapping) when the air temperature around the thermostat assembly 84 reaches the associated cut-off temperature. In such an embodiment, the temperature sensitive element may trip the unit 44 when the temperature reaches the cut-off temperature, thereby cutting off the power supply or current source (e.g., at controller 85) to the heating coils 82 and allowing the internal temperature within the air conditioner unit 10 to be reduced.

As is understood, a resettable thermostat of thermostat assembly 84 generally corresponds to a thermostat that is capable of continuously cutting off and reconnecting the power to the heating coils 82 as the temperature fluctuates above and below the predetermined cut-off temperature for the thermostat. For example, a resettable thermostat assembly 84 may include a bimetallic element that switches from a first position to a second position as the temperature increases above the cut-off temperature and then switches back to the original, first position when the temperature subsequently drops below the cut-off temperature. By contrast, a one-shot thermostat generally corresponds to a thermostat that is not configured to reconnect the power to the heating coils 82 once the temperature has increased above the predetermined cut-off temperature for the thermostat. For example, unlike resettable thermostats, a one-shot thermostat may include a one-shot thermal fuse that is configured to switch (or snap) from a first position to a second position when the temperature increases above its cut-off temperature and then remains in the second position even when the temperature subsequently drops below the cut-off temperature.

It is noted that although one or more resettable or one-shot thermostats are described above, any suitable thermostat for selectively tripping the heating unit 44 may be included in thermostat assembly 84, as would be understood.

Figure 6:
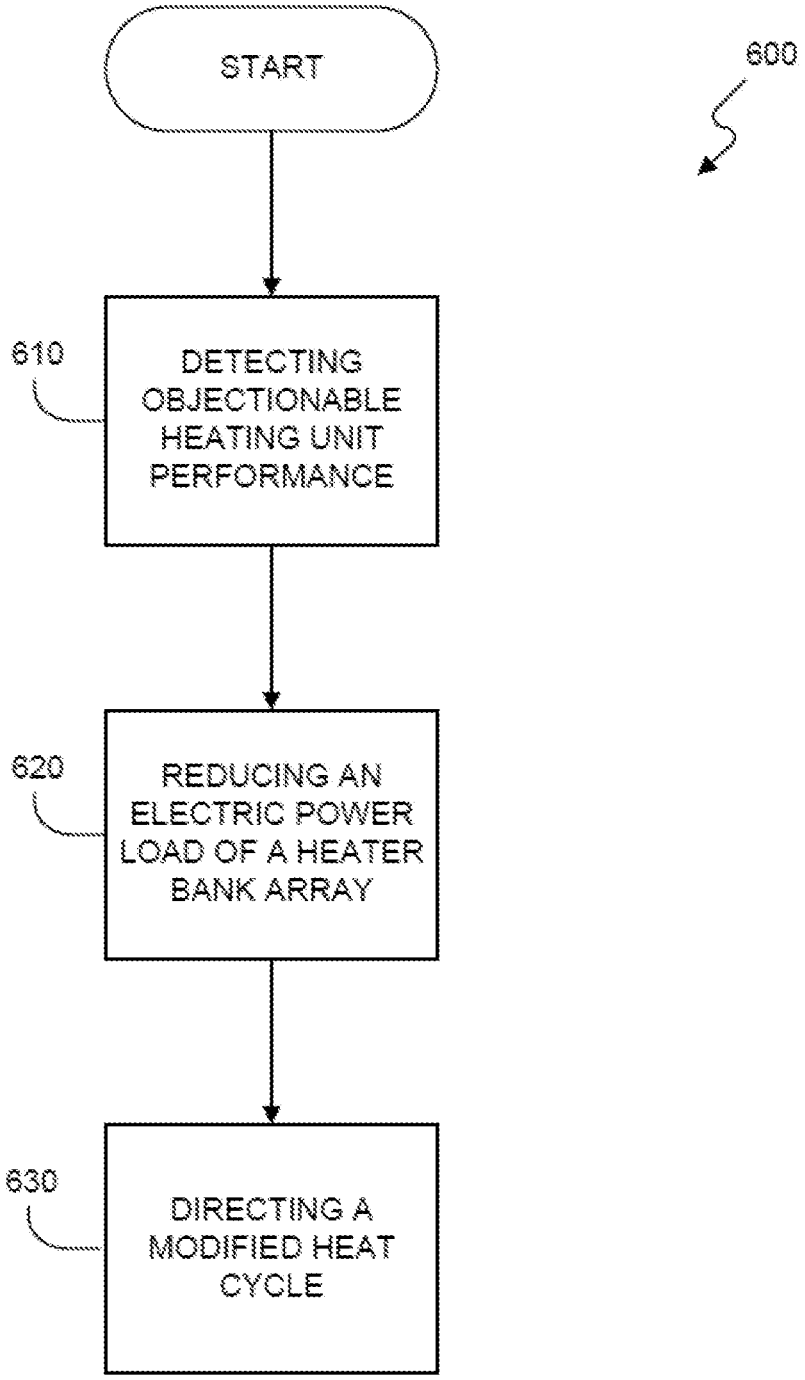
FIG. 6 provides a flow chart illustrating a method of operating an air conditioner unit according to exemplary embodiments of the present disclosure.
Figure 7:
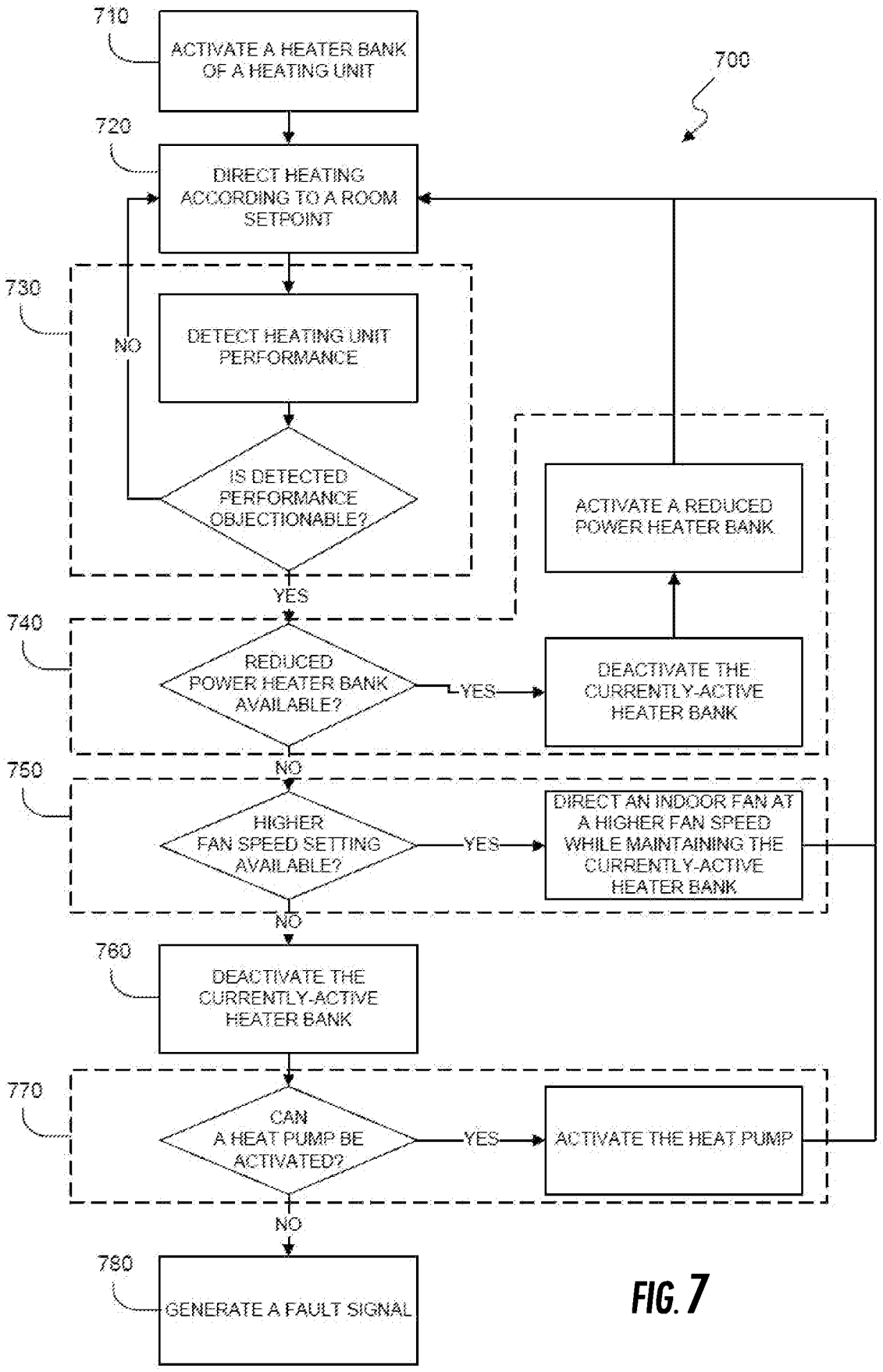
FIG. 7 provides a flow chart illustrating a method of operating an air conditioner unit according to exemplary embodiments of the present disclosure.

Referring now to FIGS. 6 and 7, the present disclosure may further be directed to methods (e.g., method 600 or 700) of operating an air conditioner or air conditioning appliance, such as air conditioner 10. In exemplary embodiments, the controller 85 (e.g., with heating unit 44) may be operable to perform various steps of a method in accordance with the present disclosure.

The methods (e.g., 600 or 700) may occur as, or as part of a heating operation of the air conditioner 10. In particular, the methods disclosed herein may advantageously ensure continuous efficient or effective heating of a corresponding room in which the air conditioner 10 is provided. Additionally or alternatively, the methods (e.g., 600 or 700) may advantageously protect portions of the air conditioner 10, such as from overcycling, thereby ensuring reliability of the air conditioner 10.

It is noted that the order of steps within methods 600 and 700 are for illustrative purposes. Moreover, neither method 600 nor 700 is mutually exclusive. In other words, methods within the present disclosure may include either or both of methods 600 and 700. Both may be adopted or characterized as being fulfilled in a common operation. Except as otherwise indicated, one or more steps in the below method 600 or 700 may be changed, rearranged, performed in a different order, or otherwise modified without deviating from the scope of the present disclosure.

Turning especially to FIG. 6, at 610, the method 600 includes detecting objectionable heating unit performance of a heater bank array. As described above, the heater bank array may include a number of heater banks at different rated power levels. Thus, prior to 610, a heating cycle may be initiated and at least one heater bank may be activated (e.g., to cycle on-off according to a duty cycle or thermostat assembly) such that an electrical current is directed thereto, as would be understood. Moreover, a fan (e.g., blower fan within the indoor portion) may be activated to motivate air across of the heating unit or heater bank array, as described above. For instance, the fan may be directed to rotate at a predetermined speed setting (e.g., based on relative rotational speed or a predetermined volumetric flow rate of air through indoor portion). Generally, objectionable heating unit performance may thus be performance that is contrary to expected or desired performance during a heating cycle (e.g., started or initiated prior to 610).

As an example, objectionable heating unit performance may be based on insufficient power consumption (e.g., at the currently-active heater bank or heater bank activated during 610). In other words, 610 may include determining insufficient heating unit performance. In some such embodiments, detecting objectionable heating unit performance includes detecting power consumption (e.g., in Watts) at the heating unit and comparing the detected power consumption to a predetermined expected consumption threshold. For instance, the power consumption may be determined from the percentage of time that a given heater bank is active during a predefined period (e.g., measured in minutes). As noted above, the thermostat assembly may trip (i.e., halt the electrical current to) an activated heater bank once the cut-off temperature is met or exceeded (e.g., before permitting the current to the heater bank to continue once the temperature at the thermostat assembly falls below the cut-off temperature). The heater bank may have a set power load (e.g., low, intermediate, or high). Thus, power consumption may be calculated, for instance, by multiplying the set power consumption by the percentage of time in which a current is permitted to the heater bank. If the calculated power consumption is less than the expected consumption threshold, objectionable heating unit performance may be determined.

As an additional or alternative example, objectionable heating unit performance may be based on an insufficient change in temperature (e.g., at the indoor portion). Specifically, the insufficient change in temperature may be between the temperature of air within the room in which the air conditioner is installed and the air being output by the air conditioner unit. In some embodiments, 610 includes determining an insufficient change in temperature between an air inlet (e.g., at an indoor ambient temperature sensor) and an air outlet (e.g., at an indoor outlet temperature sensor). For instance, a change in temperature between the air inlet and the air outlet may be calculated. Once calculated, the change in temperature may be compared to a predetermined change threshold (e.g., corresponding to an amount of temperature increase—in degrees—expected for the set power consumption of an activated heater bank). Additionally or alternatively, the calculated change in temperature may be used to further calculate an estimated heating capacity (e.g., in BTU per hour), which may then be compared to a predetermined output capacity. If the calculated change in temperature does not indicate the expected change in temperature or heating capacity is being met, objectionable performance may be determined.

As a further additional or alternative example, objectionable heating unit performance may be based on an excessive outlet air temperature. In some embodiments, 610 includes determining an output air temperature at an air outlet (e.g., at an indoor outlet temperature sensor) exceeds a maximum temperature threshold (e.g., programmed within the controller). The air outlet temperature exceeding the maximum temperature threshold may indicate, for instance, heated air is trapped upstream from the outlet (e.g., such when the air outlet is unexpectedly blocked). Thus, objectionable performance may be determined by detecting the air outlet temperature is greater than the maximum temperature threshold.

As a still further additional or alternative example, objectionable heating unit performance may be based on improper cycling (i.e., tripping) of the thermostat assembly. In some embodiments, 610 can thus include determining improper cycling at the heater bank array. For instance, the number of instances that the thermostat assembly trips within a predefined period of time (e.g., measured in minutes from the start of a current flowing through the thermostat assembly) may be detected as a tripping rate. The detected tripping rate may then be compared to a tripping rate threshold. If the detected tripping rate is greater than or equal to the tripping rate threshold, objectionable heating unit performance may be determined. Additionally or alternatively, the time in which the heater bank operates before tripping may be detected as a continuous run time (e.g., measured in minutes from the start of a current flowing through the thermostat assembly). The detected continuous run time may then be compared to a minimum run time (e.g., programmed within the controller). If the detected continuous run time is less than the minimum run time, objectionable heater performance may be determined.

At 620, the method 600 includes reducing an electric power load of the heater bank array in response to detecting objectionable heating unit performance. As an example, the currently-active heater bank may be deactivated. Thus, an electrical current may to the heater bank activated at 610 may be halted (e.g., at the controller or power source). The halting of the current may be separate from the thermostat assembly and effectively prevent electrical heat generation at the corresponding heater bank, regardless of the temperature at the thermostat assembly. Thus, deactivating the currently-active heater bank may require more than simply tripping the thermostat assembly. Moreover, peak power consumption at the heater unit may be reduced. For instance, if the heater bank at 610 was a high power heater bank, further heat generation at the high power heater bank may be prevented. Even if a reduced power (e.g., medium or low power) heater bank is later activated, the power load and peak power consumption will be less than that of the high power heater bank.

At 630, the method 600 includes directing a modified heat cycle based on detecting objectionable heating unit performance (e.g., following or in response to 620). If the heater bank activated at 610 was a high power heater bank, a reduced power heater bank (e.g., medium power or low power, respectively) may be activated at 630. Additionally or alternatively, 630 may include activating a heat pump (i.e., directing a heat pump cycle, as described above). Once the reduced power heater bank or heat pump is activated, the heating unit may be directed to heat air according to a selected setpoint temperature (e.g., for the room in which the air conditioner unit is mounted), as would be understood. For instance, the reduced power heating unit or heat pump may be cycled on-off to reach or maintain the selected setpoint temperature. As would be understood, during 630, the thermostat assembly may trip (i.e., halt the current to) the reduced power heater bank if and when the cut-off temperature is met or exceeded (e.g., before permitting the current to the reduced power heater bank to continue once the temperature at the thermostat assembly falls below the cut-off temperature).

Optionally, at 630, further activation of the heater bank activated at 610 may be prevented for a set period of time or until a programmed condition is met. As an example, during 630, continuous heating of the reduced power heater bank may be detected. In other words, the reduced power heater bank may receive a current constantly, without tripping the thermostat assembly, until the selected setpoint is reached. Subsequently, such as in response to detecting a temperature below the setpoint (or a hysteresis thereof), the high power heater bank may be activated (e.g., reactivated) to continue the heating cycle.

Additionally or alternatively, 630 may include changing a fan speed setting (e.g., within the indoor portion). Thus, a setting for airflow across the heater bank may be altered. For instance, if the fan speed setting at 610 (e.g., current fan speed setting) is a relatively low fan speed setting, 630 may include directing the fan to rotate at a relatively high fan speed setting. If the heat pump is activated and the fan speed setting at 610 is a relatively high fan speed setting, 630 may include directing the fan to rotate at a relatively low fan speed setting.

Following, or as part of 630, one or more of the above steps may be repeated. Thus, further modified heating cycles may be directed. If (e.g., in response to) a second or subsequent instance of objectionable heating performance being determined, a fault signal may be generated, for instance, to halt the heating cycle (e.g., prevent activation of all heater banks or heat pump) or transmitting a fault code (e.g., to the user interface as a visual or audio message).

Turning now to FIG. 7, at 710, the method 700 includes activating a heater of a heating unit, as described above. In particular, the heater bank may be activated as part of an initiated heating cycle. As described above, the heater bank array may include a number of heater banks at different rated power levels. Thus, prior to or concurrently with 710, a heating cycle may be initiated, as would be understood. Moreover, a fan (e.g., blower fan within the indoor portion) may be activated to motivate air across of the heating unit or heater bank array, as described above. For instance, the fan may be directed to rotate at a predetermined speed setting (e.g., based on relative rotational speed or a predetermined volumetric flow rate of air through indoor portion).

At 720, the method 700 includes directing heating of the air conditioner unit according to a room setpoint or setpoint temperature (e.g., selected by a user). As would be understood, heat generation at the heater bank may be started-stopped (i.e., cycled on-off) such that the room setpoint is met or maintained (e.g., within a programmed hysteresis or range).

At 730, the method 700 includes evaluating heater bank performance. In particular, the performance of the heater bank may be evaluated to determine if the performance is objectionable. Generally, objectionable heating unit performance may be performance that is contrary to expected or desired performance during 720.

As an example, objectionable heating unit performance may be based on insufficient power consumption (e.g., at the currently-active heater bank or heater bank activated during 720). In other words, 730 may include determining insufficient heating unit performance. In some such embodiments, detecting objectionable heating unit performance includes detecting power consumption (e.g., in Watts) at the heating unit and comparing the detected power consumption to a predetermined expected consumption threshold. For instance, the power consumption may be determined from the percentage of time that a given heater bank is active during a predefined period (e.g., measured in minutes). As noted above, the thermostat assembly may trip (i.e., halt the electrical current to) an activated heater bank once the cut-off temperature is met or exceeded (e.g., before permitting the current to the heater bank to continue once the temperature at the thermostat assembly falls below the cut-off temperature). The heater bank may have a set power load (e.g., low, intermediate, or high). Thus, power consumption may be calculated, for instance, by multiplying the set power consumption by the percentage of time in which a current is permitted to the heater bank. If the calculated power consumption is less than the expected consumption threshold, objectionable heating unit performance may be determined.

As an additional or alternative example, objectionable heating unit performance may be based on an insufficient change in temperature (e.g., at the indoor portion). Specifically, the insufficient change in temperature may be between the temperature of air within the room in which the air conditioner is installed and the air being output by the air conditioner unit. In some embodiments, 730 includes determining an insufficient change in temperature between an air inlet (e.g., at an indoor ambient temperature sensor) and an air outlet (e.g., at an indoor outlet temperature sensor). For instance, a change in temperature between the air inlet and the air outlet may be calculated. Once calculated, the change in temperature may be compared to a predetermined change threshold (e.g., corresponding to an amount of temperature increase—in degrees—expected for the set power consumption of an activated heater bank). Additionally or alternatively, the calculated change in temperature may be used to further calculate an estimated heating capacity (e.g., in BTU per hour), which may then be compared to a predetermined output capacity. If the calculated change in temperature does not indicate the expected change in temperature or heating capacity is being met, objectionable performance may be determined.

As a further additional or alternative example, objectionable heating unit performance may be based on an excessive outlet air temperature. In some embodiments, 730 includes determining an output air temperature at an air outlet (e.g., at an indoor outlet temperature sensor) exceeds a maximum temperature threshold (e.g., programmed within the controller). The air outlet temperature exceeding the maximum temperature threshold may indicate, for instance, heated air is trapped upstream from the outlet (e.g., such when the air outlet is unexpectedly blocked). Thus, objectionable performance may be determined by detecting the air outlet temperature is greater than the maximum temperature threshold.

As a still further additional or alternative example, objectionable heating unit performance may be based on improper cycling (i.e., tripping) of the thermostat assembly. In some embodiments, 730 can thus include determining improper cycling at the heater bank array. For instance, the number of instances that the thermostat assembly trips within a predefined period of time (e.g., measured in minutes from the start of a current flowing through the thermostat assembly) may be detected as a tripping rate. The detected tripping rate may then be compared to a tripping rate threshold. If the detected tripping rate is greater than or equal to the tripping rate threshold, objectionable heating unit performance may be determined. Additionally or alternatively, the time in which the heater bank operates before tripping may be detected as a continuous run time (e.g., measured in minutes from the start of a current flowing through the thermostat assembly). The detected continuous run time may then be compared to a minimum run time (e.g., programmed within the controller). If the detected continuous run time is less than the minimum run time, objectionable heater performance may be determined.

If performance is determined not to be objectionable (i.e., be within the expected or desired performance), the method 700 may return to 720 to continue the heating cycle (e.g., until stopped by a user or otherwise halted). Optionally, a different heater bank having a higher power load than the heater bank activated during 730 may be activated (e.g., in response to detecting continuous heating of a reduced power heater bank). By contrast, if performance is determined to be objectionable, the method 700 may proceed to 740.

At 740, the method 700 includes reducing an electric power load to the heater bank. In some embodiments, 740 includes determining if a reduced power heater bank can be activated. In other words, 740 may include determining if the heater bank activated during 720 or 730 is a relatively high power (e.g., high power or medium power) heater bank such that there is at least one other heater bank within the heater bank array that operates at a reduced power load (e.g., a medium power heater bank or a low power heater bank) compared to the heater bank activated at 720 or 730. If so, the relatively high power heater bank may be deactivated such that further activation thereof is prevented (e.g., for the remainder of the heating cycle, for a set period of time, or until a programmed condition is met). Moreover, a reduced power (e.g., medium power or low power) heater bank may be activated. Following activation of the reduced power heater bank, the method 700 may return to 720.

At 750, the method 700 includes adjusting a fan speed setting. Thus, a setting for airflow across the heater bank may be altered. For instance, if the fan speed setting at 710 or 720 (e.g., current fan speed setting) is a relatively low fan speed setting, 750 may include directing the fan to rotate at a relatively high fan speed setting. If the heat pump is activated and the fan speed setting at 710 or 720 is a relatively low fan speed setting, 750 may include directing the fan to rotate at a relatively high fan speed setting. Although the fan speed setting is adjusted at 750, the currently-active heater bank may be maintained. Thus, if the heater bank that is active during 730 is a reduced power (e.g., low power) heater bank, 750 may include changing the fan speed to a high fan speed setting while an electrical current is permitted to the reduced power heater bank (e.g., to cycle on-off). Following 750, the method 700 may return to 720.

At 760, the method 700 includes deactivating any currently-active heating coil, further reducing the electric power load to the heater bank. Thus, if any heater bank is active at 730, that heater bank and every other heater bank of the heating unit may be prevented from activating or otherwise generating heat from an electrical current.

At 770, the method 700 includes directing a heat pump. Specifically, if a heat pump cycle is not being performed (e.g., at 730), the heat pump cycle may be initiated and directed (e.g., as described above). Once the heat pump cycle is initiated, the method 700 may return to 720. Nonetheless, if the heat pump cycle was already being performed (e.g., at 730) or is otherwise unavailable, the method 700 may proceed to 780.

At 780, the method 700 includes generating a fault signal. For instance, the fault signal may direct the controller to halt the heating cycle (e.g., automatically or without receiving any direct user input). Additionally or alternatively, a fault code may be transmitted, such as to the user interface of the air conditioner unit. Once received, the fault code may be presented as a visual or audio message to a user, as such messages are generally understood.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an air conditioner unit comprising:

detecting objectionable heating unit performance of a heater bank array of the air conditioner unit, the plurality of heater bank array comprising a high power heater bank and a reduced power heater bank, the reduced power heater bank being distinct from the high power heater bank;

reducing an electric power load of the heater bank array in response to detecting objectionable heating unit performance; and directing a modified heat cycle based on detecting objectionable heating unit performance, wherein reducing the electric power comprises deactivating the high power heater bank, and wherein directing the modified heat cycle comprises activating the reduced power heater bank operating at a lower load than the high power heater bank.

2. The method of claim 1, wherein detecting objectionable heating unit performance comprises determining insufficient power consumption at the heater bank array.

3. The method of claim 1, wherein detecting objectionable heating unit performance comprises determining an insufficient change in temperature between an air inlet of the air conditioner unit an air outlet of the air conditioner unit.

4. The method of claim 1, wherein detecting objectionable heating unit performance comprises determining an output air temperature at an air outlet of the air conditioner unit exceeds a maximum temperature threshold.

5. The method of claim 1, wherein detecting objectionable heating unit performance comprises determining improper cycling at the heater bank array.

6. The method of claim 1, wherein directing the modified heat cycle comprises activating a heat pump.

7. The method of claim 1, wherein directing the modified heat cycle comprises detecting continuous heating of the reduced power heater bank following activating the reduced power heater bank, and activating the high power heater bank in response to detecting continuous heating.

8. The method of claim 1, wherein directing the modified heat cycle comprises changing a fan speed setting.

9. An air conditioner unit defining a mutually-perpendicular vertical direction, lateral direction, and transverse direction, the single-package air conditioner unit comprising:

a cabinet defining an outdoor portion and an indoor portion;

an outdoor heat exchanger disposed in the outdoor portion;

an indoor heat exchanger disposed in the indoor portion;

a compressor in fluid communication with the outdoor heat exchanger and the indoor heat exchanger to circulate a refrigerant between the outdoor heat exchanger and the indoor heat exchanger;

a heater bank array comprising a plurality of heater banks mounted within the indoor portion, the plurality of heater banks comprising a high power heater bank and a reduced power heater bank, the reduced power heater bank being distinct from the high power heater bank; and a controller in operative communication with the compressor and the heater bank array, the controller being configured to initiate a heating operation, the heating operation comprising detecting objectionable heating unit performance of the heater bank array, reducing an electric power load of the heater bank array in response to detecting objectionable heating unit performance, and directing a modified heat cycle based on detecting objectionable heating unit performance, wherein reducing the electric power comprises deactivating the high power heater bank, and wherein directing the modified heat cycle comprises activating the reduced power heater bank operating at a lower load than the high power heater bank.

10. The air conditioner unit of claim 9, wherein detecting objectionable heating unit performance comprises determining insufficient power consumption at the heater bank array.

11. The air conditioner unit of claim 9, wherein detecting objectionable heating unit performance comprises determining an insufficient change in temperature between an air inlet of the air conditioner unit an air outlet of the air conditioner unit.

12. The air conditioner unit of claim 9, wherein detecting objectionable heating unit performance comprises determining an output air temperature at an air outlet of the air conditioner unit exceeds a maximum temperature threshold.

13. The air conditioner unit of claim 9, wherein detecting objectionable heating unit performance comprises determining improper cycling at the heater bank array.

14. The air conditioner unit of claim 9, wherein directing the modified heat cycle comprises initiating a heat pump cycle at the compressor.

15. The air conditioner unit of claim 9, wherein directing the modified heat cycle comprises detecting continuous heating of the reduced power heater bank following activating the reduced power heater bank, and activating the high power heater bank in response to detecting continuous heating.

16. The air conditioner unit of claim 9, further comprising a fan mounted within the indoor portion to motivate an airflow therethrough, wherein directing the modified heat cycle comprises changing a fan speed setting of the fan.

* * * * *